United States Patent [19]

Politzer et al.

[11] 4,130,047

[45] Dec. 19, 1978

[54] SEALING SYSTEM FOR A WEDGE-TYPE BREECH MECHANISM

[76] Inventors: Anton Politzer, Robert-Koch-Str. 18, 8520 Lauf/Pegn., Germany; Wilhelm Machmer, Salzburger Str. 34, 8500 Nürnberg, Germany

[21] Appl. No.: 752,827

[22] Filed: Dec. 6, 1976

[30] Foreign Application Priority Data

Dec. 5, 1975 [DE] Fed. Rep. of Germany ..... 2554728

[51] Int. Cl.[2] ..... F41F 11/02

[52] U.S. Cl. ..... 89/26; 89/24

[58] Field of Search ..... 89/24, 26

[56] References Cited

U.S. PATENT DOCUMENTS

| | | | |
|---|---|---|---|
| 983,781 | 2/1911 | Smith | 89/26 |
| 3,707,900 | 1/1973 | Hornfeck et al. | 89/26 |

FOREIGN PATENT DOCUMENTS

| | | | |
|---|---|---|---|
| 15309 of | 1911 | United Kingdom | 89/26 |

*Primary Examiner*—Stephen C. Bentley

*Attorney, Agent, or Firm*—Haseltine, Lake, & Waters

[57] ABSTRACT

A system for sealing a wedge-type breech mechanism for a weapon firing caseless ammunition using a clamping stud in the external drive and enclosed in a recess provided in a wedge which axially presses a sealing ring against the sealing surface of a chamber wherein gear actuated clamping studs press a sealing ring against its sealing surface by a radially displaceable segment.

7 Claims, 8 Drawing Figures

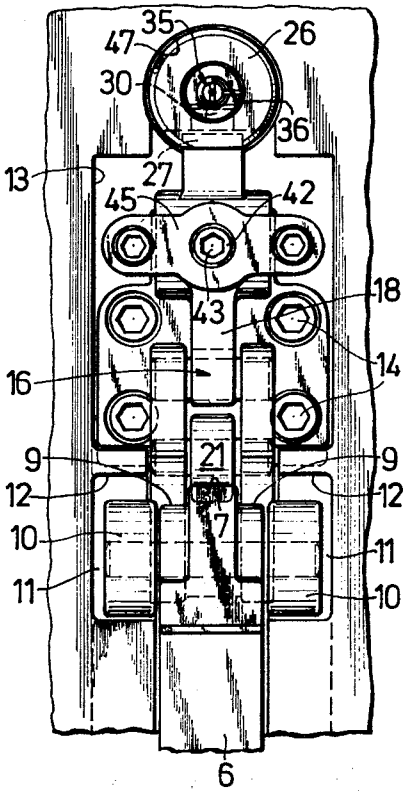
Fig. 2
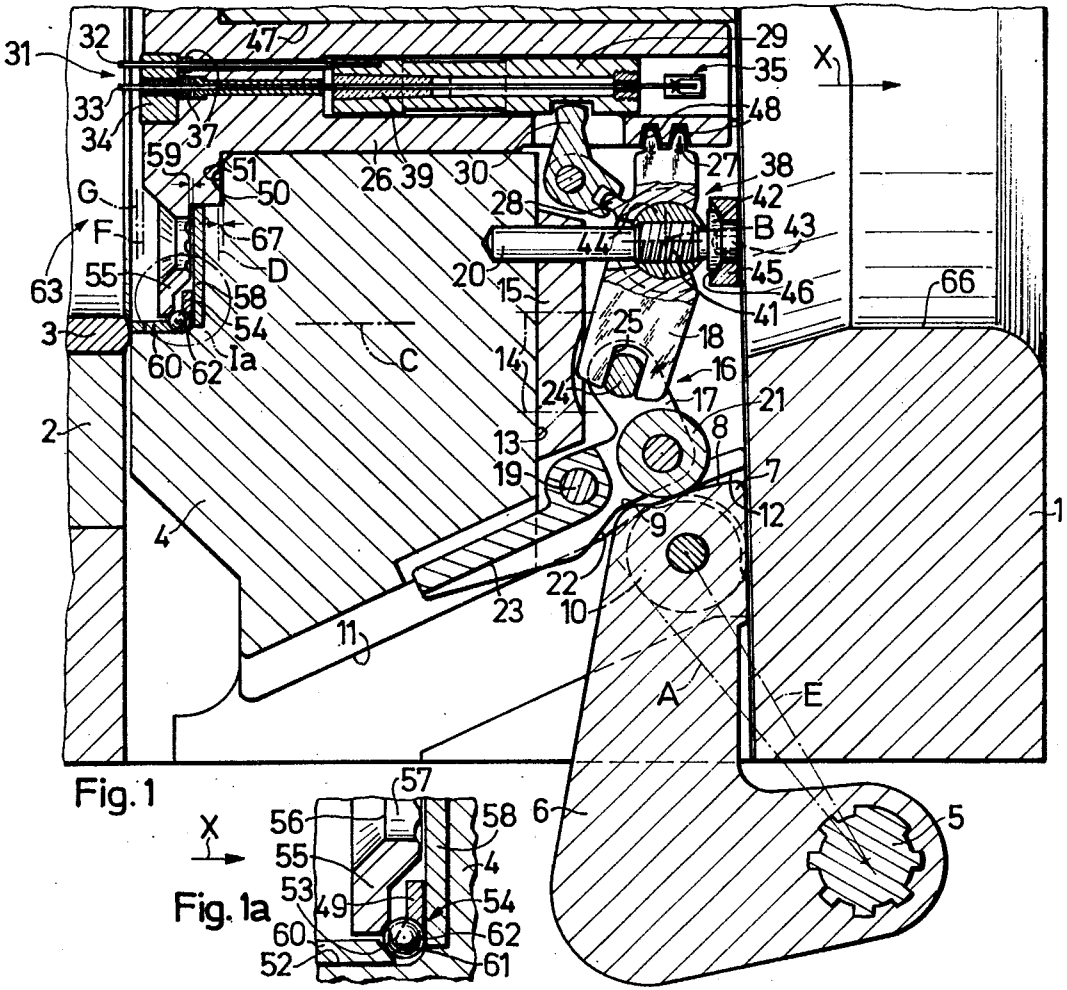
Fig. 1
Fig. 1a

SEALING SYSTEM FOR A WEDGE-TYPE BREECH MECHANISM

BACKGROUND OF THE INVENTION

This invention relates to a system of sealing wedge-type gun breech mechanisms.

A former proposal of the claimant (P No. 24 35 520) related to a wedge-type breech mechanism using a sealing ring which is pre-loaded by a gear system, designed for weapons firing caseless ammunition. Both, the sealing ring and the gear system are comprised in a recess provided in the wedge. The sealing ring axially slides into contact with the plane surface of the barrel; this feature is provided by a clamping stud supported by the wedge and an intermediate ring engaged with the clamping stud by a worm. Both, the clamping stud and the intermediate ring are provided with vent holes.

Prior to opening the wedge, load is relieved from the sealing ring by sliding back the intermediate ring. Thus, the sealing ring returns from the plane surface of the barrel, when the wedge extends. This proposal ensures a gasproof sealing of the breech with weapons generating gas pressures up to 4,500 bars. With extremely high gas pressures involved — up to 8,000 bars — however, the strength of the lateral walls of the wedge comprising the sealing system is affected to such extent that service life can no longer be guaranteed. The reason is that the wedge is provided with a relatively deep longitudinal recess which is necessary to house the sealing ring and the gear system, thus reducing the bending strength of the lateral walls of the wedge which could be broken.

SUMMARY OF THE INVENTION

An object of this invention is to provide a space-saving sealing system for extremely high gas pressures. The advantage is that the gas pressure of a caseless ammunition acting on the base will intensify the mechanically generated specific surface pressure of the sealing ring against the plane surface of the barrel whereby the degree of intensification depends on the gas pressure. Another advantage is the relatively flat design of this sealing system consisting of very few parts, ensuring that the strength limit of the lateral walls of the wedge is not exceeded. Furthermore, a sealing system of such type can be integrated in a wedge without any modification of the breech contours.

There is also recited a rapidly responding, pressure-actuated supporting of the ring respectively the intermediate ring; a space-saving drive coupling between clamping stud and sealing ring; particularly flat and reliable shift segments; and the latter with different drive systems.

BRIEF DESCRIPTION OF THE DRAWINGS

Practical examples of this invention are illustrated by a drawing which shows in particular:

FIG. 1 is a cross section of a sealing system integrated in a wedge type breech mechanism of a firearm FIG. 1*a* is a detail from FIG. 1;

FIG. 2 is an end view of the device according to FIG. 1;

DETAILED DESCRIPTION

Figure 4:
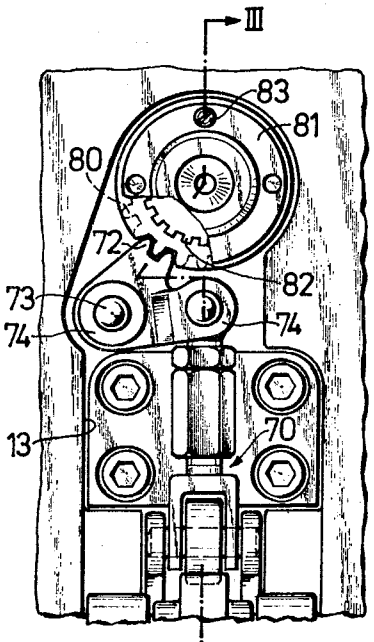
FIG. 4 is an end view of the device according to FIG. 3.

In the breech end 1 of a cannon having a barrel 2 of 150 mm caliber with a wear-resistant ring 3, a wedge 4 in locked position and a lever 6 on a shaft 5 are provided. The conventionally activated lever 6 which uses a notch 7, eccentric cam plate 8 and cams 9 is thrown into engagement with guide cams 11 of the wedge 4 via two rollers 10. Beginning with the release position A, the guide cams 11 have a section 12 which is concentric with the axis of rotation of lever 6.

Recess 13 in the wedge 4 houses — on a plate 15 attached to wedge 4 with countersunk screws 14 — a lever transmission 16 consisting of a roller-guided lever 17 and a clamping lever 18 through bolts 19, 20 in wedge 4.

With roller-guided lever 17, eccentric cam plate 8 with its roller 21 and, furthermore, two return cam plates 22, one safety return cam plate 23 and a connecting link bolt 24 are provided. The clamping lever 18 has a connecting link 25, a toothed segment 27 which is in mesh with clamping stud 26, and a cam 28. An axially displaceable sliding segment 29, actuated by cam 28 and lever 30 in wedge 4 is provided in the clamping stud 26. Furthermore, the clamping stud 26 encloses an electric ignition unit 31 with firing pins 32 and 33 mounted on the sliding segment 29.

The firing pin 32 is directly connected to the sliding segment 29 thus being electrically grounded. The firing pin 33 is insulated from the sliding segment 29, clamping stud 26, and guiding plate 34, but is rigidly connected to the sliding segment 29 by an insulating insert 39. Furthermore, the firing pin 33 is connected to a common ignition system — which is not shown here — via a sliding contact 35 and a cable 36. The firing pins 32 and 33 extend into the barrel 2 and are provided with gaskets 37.

The axis of rotation B of the clamping lever 18 is displaceable against the wedge 4. For this purpose a setting device 38 is provided in wedge 4, consisting of a rotatable bolt 20 with thread 41, bolt flange 42 and hexagonal recessed hole 44 and a bridge 45 screwed to wedge 4 and provided with a bearing seat 46.

Figure 7:
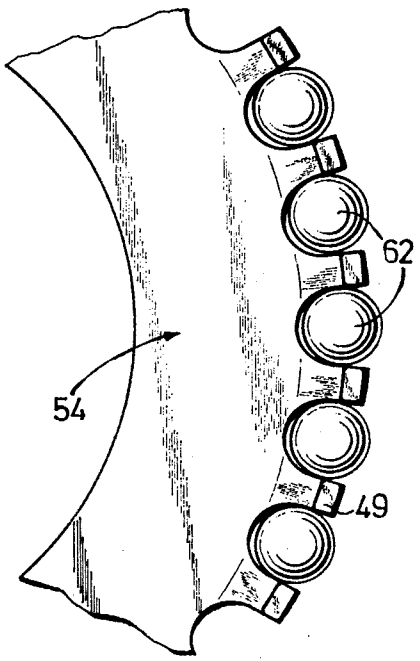
FIG. 7 is a side view of shift segment according to the embodiments of FIGS. 1 and 3.

The clamping stud 26 which is axially displaceable in hole 47 provided in wedge 4, has tooth gaps 48 corresponding with toothed segment 27 and — in the clamped configuration — abuts on the base 51 of a recess 52 in wedge 4 with its flange 50 and simultaneously abuts with its tapered section 52 on a shift segment which is designed as a ball bearing 54 with cage 49 (FIG. 7).

A tapered section 53 is engaged by means of a flange 55 which is connected to the clamping stud 26 by notches 56. Between notches 56 vent holes 57 are provided. A pressure plate 58 covers the base of recess 52. In the preloaded configuration of sealing ring 60 (see FIGS. 1 and 1*a*) the notches 56 and pressure plate 58 have a clearance 59.

A sealing ring 60 axially slidable in recess 52 has a flat trapezoidal cross section and an inside taper 61, which together with the outside taper 53 and pressure plate 58 encloses balls 62 of ball bearing 54. This sealing ring 60 is assembled against ring 3 in a manner which will eliminate any section of attack for the gas pressure acting in direction X.

With the chamber 63 open, the wedge recess, not shown in the drawing, is below the chamber 63 in position C. After feeding-in ammunition through recess 66 in the breech end 1 and proceeding to the chamber 63, wedge 4 is moved into the illustrated locked position by the hydraulically actuated arbor 5, lever 6 and rollers 10 running in the guide cams 11.

In position A of lever 6, wedge 4 remains at rest due to the concentric section 12 whereas lever 6 proceeds to clamped position E.

Beginning with position A, the eccentric cam 8 pushes up the roller lever 17 by actuating roller 21. Using the connecting link assembly 24 and 25, the clamping lever 18 moves the clamping stud 26 in direction X until its flange 50 contacts the base 51 of recess 52.

In the direction opposite to X, the firing pins 32 and 33 are actuated and come into contact with the ammunition primer, by actuating lever 30 and sliding segment 29.

An essential factor for the axial preloading of the sealing ring 60 at ring 3 is that before having reached position D, i.e. before flange 50 contacts base 51, the sealing ring 60 performs a short stroke until it contacts ring 3.

The preloading of the sealing ring 60 at ring 3 depends on the clearance 67 of position D from base 51. The flange 50 being in contact with base 51, the preloaded sealing ring 60 is in contact with ring 3, whereby the elastic notches 56 together with clearance 59 are used to limit the preload force. By suitable washers (not shown) lying on base 50, this preload force can be varied.

Contact of flange 50 with base 51 is obtained by once adjusting the setting device 38.

The gas pressure of caseless ammunition acting in direction X generates a certain energy through notches 56 and flange 55 which is reversed by the balls 62 and sealing ring 60, thus provoking an almost immediate increase of the specific surface pressure on the plane sealing surface of sealing ring 60. Simultaneously, the gas pressure expands sealing ring 60 against the wall of recess 52 so that gas penetration through the gap is impossible.

After having fired the round, lever 6 is pivoted in counterclockwise direction until the wedge syncline reaches position C. During the motion of lever 6 from position E to position A roller 21 is relieved from the eccentric cam 8. Thus the preload of sealing ring 60 is eliminated. Cam 9 slides up roller lever 17 via return guide cams 22. Thus clamping stud 26 performs a relief stroke in opposite direction of X from position F to G, via clamping lever 18, so that the external taper 53 is lifted from balls 62; sealing ring 60, ball bearing 49, and flange 55 are completely free from load and lie respectively in recess 52. This configuration is completed when lever 6 has reached position A.

During extending and retracting wedge 4, notch 7 faces the safety return cam plate 23 in order to define the position of clamping stud 26.

Figure 3:
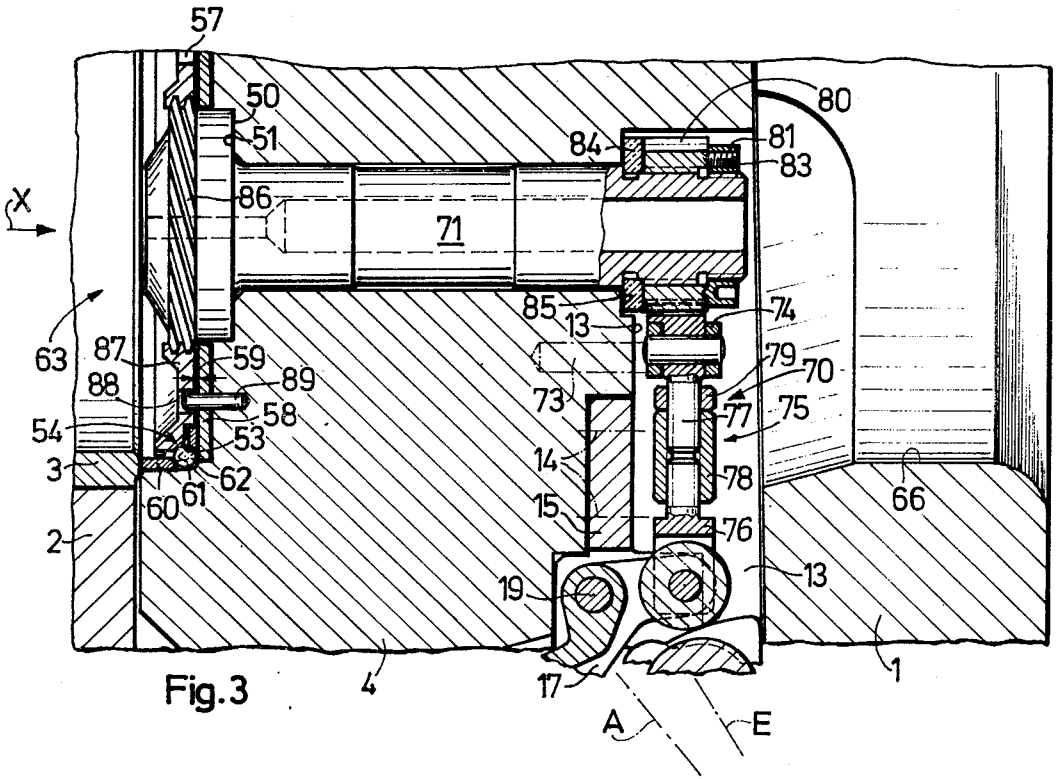
FIG. 3 is a cross section taken along line III—III in FIG. 4 of another embodiment of sealing system.

Instead of the displaceable clamping stud actuated by lever transmission 16, a rotating clamping stud 71 actuated by lever transmission 70 is used in FIGS. 3 and 4. For this purpose roller lever 17 is connected with a toothed segment 72 and a twin lever 74 rotating around a bolt 73 secured to wedge 4.

A setting device is provided between lever 74 and roller lever 17, consisting of two elastically hinged threaded pins 76 and 77, a threaded bushing 78 and a securing nut 79. Thus the preload between sealing ring 60 and ring 3 is adjustable.

A rough setting feature for the preload is given by a gearwheel with outside and inside toothing 80 which is displaceable against the toothing 82 of clamping stud 11 after having lifted the cover. Screws 83 are used to lock the cover. A supporting disk 84 is enclosed between gearwheel 80 and base 85 of recess 13.

Attached to flange 50, clamping stud 71 has a trapezoidal thread 86 in mesh with an intermediate ring 87. With sealing ring 60 being preloaded, clearance 59 is produced, as already shown in FIG. 1.

The intermediate ring 87 is secured against rotation by a pin 89 secured to the wedge end engaged in hole 88 of intermediate ring 87. As already shown in FIG. 1, intermediate ring 87 has an external taper 53 and vent holes 57.

Closing and opening the wedge 4 as well as pivoting roller lever 17 is performed in a manner described in FIG. 1. Deviating from this, the pivot motion of roller lever 17 is converted to a translative motion via threaded pins 76 and 77 and to a rotation of clamping lever 71 via lever 74.

Clamping lever 71 turns clockwise for the sealing of wedge 4, to slide intermediate ring 87 in direction X, which itself is prevented from rotating by pin 89. In consequence, balls 62 are preloaded radially and sealing ring 60 is preloaded against ring 3. The gas pressure of a caseless propellant charge acts againt intermediate ring 87 which moves in direction X due to its elasticity and its very low thread play. Sealing ring 60 is subjected to an additional press load. The specific surface pressure at ring 3 is raised. Furthermore, the specific surface pressure of flange 50 against base 51 is raised so that pressure loss is impossible as well.

Figure 6:
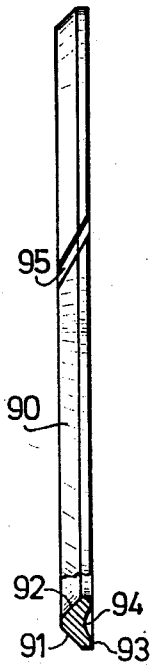
FIG. 6 shows, partially in section, a shift segment according to FIG. 5.

The sealing ring 60 is relieved in a manner similar to FIG. 1, namely, lever 6 is pivoted counter-clockwise, provoking a counter-clockwise rotation of clamping stud 71. Thus the intermediate ring 87 is lifted from the balls, which will relieve the sealing ring 60. Instead of ball bearing 54 as shown in FIGS. 1, 3, and 7, a prismatic ring 90 with two prismatic surfaces 91 and 92 is provided according to FIGS. 5 and 6. Its surface 93 facing the pressure plate has a recess to apply a lubricant 94. By means of a slot 95 this prismatic ring moves radially, i.e. for clamping the sealing ring it will expand, and it will contract for relief.

Figure 5:
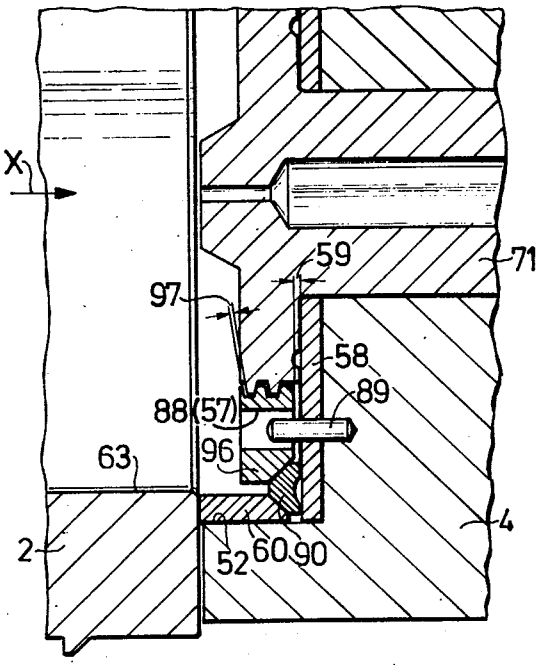
FIG. 5 is a detail from another embodiment of sealing system.

The intermediate ring 96 shown by FIG. 5 which is block-shaped and nonelastic — in contrary to FIG. 3 — uses a higher thread play 97 than the intermediate ring according to FIG. 3 in its clamped configuration. This thread play allows it to return due to the gas pressure, thus increasing the specific surface pressure against the plane surface of sealing ring 60.

Vent holes 57 in flange 55 according to FIG. 1 as well as in the intermediate rings 87 and 96 according to FIGS. 3 and 5 are designed in a manner which will allow the gas pressure to act against the flange and intermediate ring during projectile travel in the barrel, thus improving the sealing feature of sealing ring 60.

We claim:

1. Apparatus for sealing the breech member of a breech mechanism of a firearm for firing caseless ammunition, the firearm having a barrel, said apparatus comprising a clamping member movably mounted in a recess provided in the breech member, drive means coupled to the clamping member for moving the clamping member between released and operative positions, a sealing ring adjacent the barrel and means coupled to said clamping member for pressing said sealing ring against the barrel, the latter means including a radially movable shifting member which undergoes radial movement as said clamping member moves between the released and operative positions, said sealing ring having one end facing the barrel and an opposite end, said shifting member including means for applying axial force to said opposite end of the sealing ring to axially clamp the sealing ring against the barrel.

2. Apparatus as claimed in claim 1 wherein said barrel is provided with a wear-resistant ring against which said sealing ring bears when axially clamped by the shifting member.

3. Apparatus as claimed in claim 2 wherein the breech member has a further recess receiving said sealing ring and the means for pressing the sealing ring against the barrel, the latter means comprising a radial member coupled to said clamping member, said opposite end of the sealing ring being tapered and subjected to axial force by travel of the radial member with said clamping member.

4. Apparatus as claimed in claim 3 wherein said means for pressing the sealing ring against the barrel further comprises a shift member bearing against said tapered end of the sealing ring and subjected to force applied by said radial member when moved towards said operative position.

5. Apparatus as claimed in claim 4 wherein said radial member includes elastic notches.

6. Apparatus as claimed in claim 3 wherein said shift member comprises a ball-bearing and said radial member comprises a flange.

7. Apparatus as claimed in claim 3 wherein said shift member comprises a radially expandable prism ring and said radial member comprises an intermediate ring.

* * * * *